US010643553B2

(12) United States Patent
Gu et al.

(10) Patent No.: US 10,643,553 B2
(45) Date of Patent: May 5, 2020

(54) BACKLIGHT DRIVING CIRCUIT, BACKLIGHT DRIVING METHOD, BACKLIGHT DEVICE AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Qibing Gu, Beijing (CN); Bo Gao, Beijing (CN); Wei Sun, Beijing (CN); Lingyun Shi, Beijing (CN); Hao Zhang, Beijing (CN); Guangquan Wang, Beijing (CN); Ming Chen, Beijing (CN); Xue Dong, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/048,782

(22) Filed: Jul. 30, 2018

(65) Prior Publication Data

US 2019/0180700 A1 Jun. 13, 2019

(30) Foreign Application Priority Data

Dec. 12, 2017 (CN) ..... 2017 1 1322189

(51) Int. Cl.
*G09G 3/34* (2006.01)
*G09G 3/36* (2006.01)

(52) U.S. Cl.
CPC ..... *G09G 3/3426* (2013.01); *G09G 3/36* (2013.01); *G09G 2320/064* (2013.01)

(58) Field of Classification Search
CPC ..... G09G 3/34; G09G 3/36; G09G 3/3406; G09G 3/3413; G09G 3/342; G09G 3/3426; G09G 2320/064; H05B 33/0806
See application file for complete search history.

(56) References Cited

U.S. PATENT DOCUMENTS

2008/0238336 A1* 10/2008 Peng ..... G09G 3/3426 315/294
2017/0167703 A1* 6/2017 Cok ..... F21V 23/003

FOREIGN PATENT DOCUMENTS

CN 103839529 A 6/2014

OTHER PUBLICATIONS

First Office Action for CN Application No. 201711322189.6, dated Apr. 22, 2019.

* cited by examiner

*Primary Examiner* — Rodney Amadiz
(74) *Attorney, Agent, or Firm* — Foley & Lardner LLP

(57) ABSTRACT

The present disclosure relates to a backlight driving circuit, a backlight driving method, a backlight device and a display device. A backlight driving circuit for driving a light source array, comprising: a control sub-circuit for outputting a control signal and different timing voltage signals; a driving sub-circuit for providing data signals to the light source array according to the control signal; and a selection sub-circuit that corresponds to rows in the light source array, wherein the selection sub-circuit is configured to control the turning-on of light sources of the corresponding rows in the light source array according to the timing voltage signals outputted by the control sub-circuit.

14 Claims, 5 Drawing Sheets

BACKLIGHT DRIVING CIRCUIT, BACKLIGHT DRIVING METHOD, BACKLIGHT DEVICE AND DISPLAY DEVICE

CROSS-REFERENCE TO RELATED APPLICATIONS

The present application claims priority to Chinese Patent Application No. 201711322189.6 filed on Dec. 12, 2017, the disclosure of which is hereby incorporated by reference in its entirety.

FIELD

The present disclosure relates to the field of display technology, and in particular to a backlight driving method, a backlight driving circuit, a backlight device and a display device.

BACKGROUND

With the development of the display panel manufacturing industry, display technology such as high-resolution AR/VR/TV/MNT is continuously improving. The requirements for a change in brightness become higher and higher. The traditional LCD modules are week in aspects of stability and brightness, but strong in aspects of cost, power consumption and production capacity. In AR&VR products for short distances, technologies of inserting black frames will be applied in order to prevent dizziness resulted from the inflection of liquid crystals. This technology requires the backlight source has a very high instant brightness. For solutions improving working current of LEDs, a direct type backlight is commonly adopted to improve working currents of LEDs so that the brightness may be improved.

SUMMARY

According to one aspect of the present disclosure, there is provided a backlight driving circuit for driving a light source array, comprising: a control sub-circuit for outputting a control signal and different timing voltage signals; a driving sub-circuit for providing data signals to the light source array according to the control signal; and a selection sub-circuit that corresponds to rows in the light source array, wherein the selection sub-circuit is configured to control the turning-on of light sources of the corresponding rows in the light source array according to the timing voltage signals outputted by the control sub-circuit.

In some embodiments of the present disclosure, the selection sub-circuit includes one or more multiplexers (MUXs).

In some embodiments of the present disclosure, the light source array includes M rows and N columns, and the selection sub-circuit includes K MUXs that are 1:Q, wherein M, N, K and Q are all positive integers, and $K \times Q = M$; and the driving sub-circuit includes K driver ICs, each driver IC includes N output channels, the N output channels and the N columns of the light source array are in one to one correspondence, and each driver IC provides the data signals to corresponding Q rows of light sources.

In some embodiments of the present disclosure, at least one of the one or more MUXs includes W switching transistors and a driver IC with W output channels, the output channels of the driver IC are connected to control electrodes of the switching transistors in one to one correspondence, first electrodes of the switching transistors are connected to a power source terminal, second electrodes of the switching transistors are connected to corresponding row of the light source array, and the control electrodes are also connected to a high level terminal, W is a positive integer and $W \geq 2$.

In some embodiments of the present disclosure, the control sub-circuit is further configured to input timing voltage signals satisfying a preset delay to the MUXs that correspond to two adjacent rows in the light source array, such that the rows are turned on sequentially.

In some embodiments of the present disclosure, the selection sub-circuit includes a plurality of MUXs, and rows of the light source array that corresponds to the same MUX are not adjacent to one another.

In some embodiments of the present disclosure, rows of the light source array are numbered sequentially from 1 to M, the serial numbers of the rows in the light source array corresponding to the same MUX are in an arithmetic progression with a common difference of K.

In some embodiments of the present disclosure, M=20, K=5, Q=4.

According to another aspect of the present disclosure, there is provided a backlight device, comprising the above backlight driving circuit according to the present disclosure.

According to a still further aspect of the present disclosure, there is provided a display device, comprising the above backlight device according to the present disclosure.

According to a still further aspect of the present disclosure, there is provided a method for driving a light source array, comprising: outputting, by a control sub-circuit, a control signal and different timing voltage signals; providing, by a driving sub-circuit, data signals to the light source array according to the control signal; and controlling, by a selection sub-circuit that corresponds to rows in the light source array, the turning-on of light sources of the corresponding rows in the light source array according to the timing voltage signals outputted by the control sub-circuit.

In some embodiments of the present disclosure, the selection sub-circuit includes one or more multiplexers (MUXs).

In some embodiments of the present disclosure, outputting, by the control sub-circuit, different timing voltage signals comprises: inputting, by the control sub-circuit, timing voltage signals satisfying a preset delay to the MUXs that correspond to two adjacent rows in the light source array, such that the rows are turned on sequentially.

In some embodiments of the present disclosure, a delay between the timing voltage signals received by the same MUX is equal to or larger than a width of the timing voltage signals.

In some embodiments of the present disclosure, the selection sub-circuit includes a plurality of MUXs, and rows of the light source array that corresponds to the same MUX are not adjacent to one another.

In some embodiments of the present disclosure, delays among the timing voltage signals received by the plurality of MUXs are smaller than a width of the timing voltage signals.

DETAILED DESCRIPTIONS

In order to make the above objects, features, and advantages of the present disclosure more comprehensible, the present disclosure will be further described in detail with reference to the accompanying drawings and specific embodiments.

Display panels have a higher and higher requirement for brightness contrast, in which conventional LCD devices are at a disadvantage in working stability and brightness, but are at an advantage in cost, power consumption, and production capacity. Especially in close-distance AR & VR products, in order to prevent vertigo caused by the deflection of liquid crystals, the application of inserting black frames is required. This technology requires a backlight source having a very high instantaneous brightness. Currently, the solution of increasing the operating current of the LED usually adopts a direct-type backlight to increase the operating current of the LED so as to achieve an increase in brightness. Although the direct-type backlight can solve the problem of the LED operating current, a problem of an increased number of LED Driver ICs arises in consequence. For example: for a 1000-zone backlight device composed of 1000 LEDs in which the existing 16-channel LED Driver ICs are used, 63 LED Driver ICs are needed. Due to the large number of LED Driver ICs, the cost is greatly increased, as well as the PCB size. More serious is that the above method can not be applied to small size products, such as VR products.

The present disclosure provides a backlight driving method, a backlight driving circuit, a backlight device, and a display device to solve the problem that the existing backlight driving method needs a large number of LED driving circuits and cannot be applied to small size products.

Figure 1:
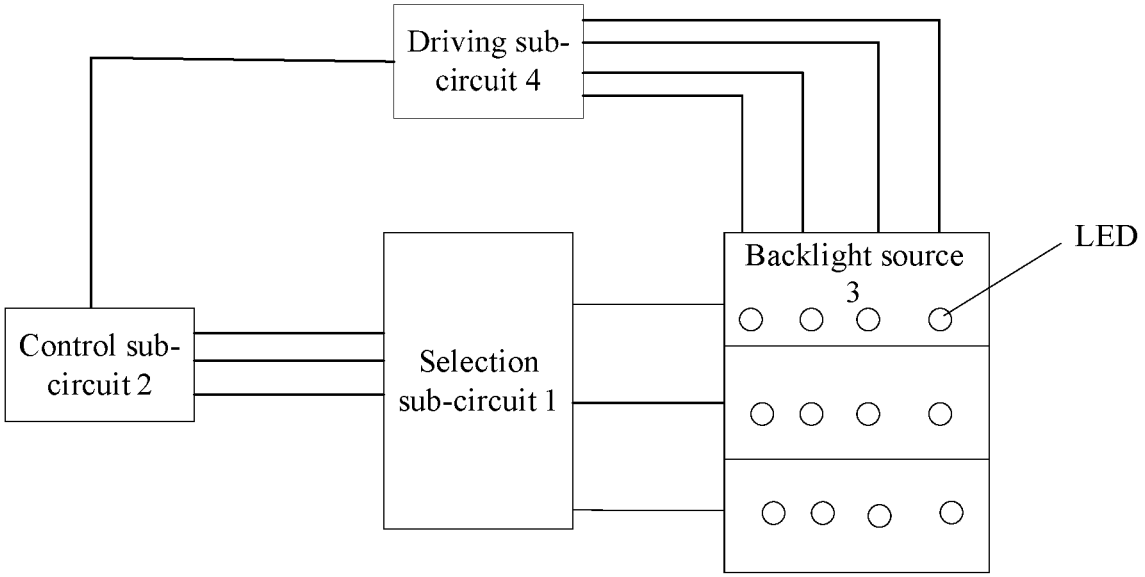
FIG. 1 is a structural block diagram of a backlight driving device according to an embodiment of the present disclosure.

Referring to FIG. 1, which shows a backlight driving circuit according to an embodiment of the present disclosure. The backlight driving circuit is used to drive a backlight source 3 including a plurality of point light sources arranged in an array (i.e., a light source array). The backlight driving circuit includes a control sub-circuit 2, a selection sub-circuit 1 and a driving sub-circuit 4.

The control sub-circuit 2 is correspondingly connected to the selection sub-circuit 1 and the driving sub-circuit 4. The control sub-circuit 2 may output different timing voltage signals to the selection sub-circuit 1. Also, the control sub-circuit 2 may output a control signal to the driving sub-circuit 4.

The selection sub-circuit 1 is further connected with corresponding rows of point light sources in the backlight source 3, and are used to control the turning-on of the corresponding rows of point light sources according to the timing voltage signals output by the control sub-circuit 2. For example, the selection sub-circuit 1 may select one or more rows of point light sources in the backlight source 3 to be turned on.

The driving sub-circuit 4 can provide data signals to columns of point light sources in the backlight source 3 according to the control signal from the control sub-circuit 2.

The point light sources may be light emitting diodes (LEDs), but the point light sources of the present disclosure are not limited to LEDs.

According to an embodiment of the present disclosure, the backlight device includes a backlight 3 and a backlight driving circuit. The backlight source 3 includes a plurality of point light sources arranged in an array. The backlight driving circuit includes: a control sub-circuit 2, a selection sub-circuit 1 and a driving sub-circuit 4. The control sub-circuit 2 is correspondingly connected to the driving sub-circuit 4 and the selection sub-circuit 1, and is used to output different timing voltage signals to the selection sub-circuit 1. Also, the control sub-circuit 2 is configured to output a control signal to the driving sub-circuit 4. The selection sub-circuit 1 is further connected with corresponding rows of point light sources of the backlight device 3, and are used to control the turning-on of the corresponding rows of point light sources according to the timing voltage signals output by the control sub-circuit 2. The driving sub-circuit 4 may provide data signals to the backlight source 3 according to the control signal from the control sub-circuit 2, thereby control the turning-on of respective columns in the point light source array of the backlight source 3. With the selection sub-circuit controlling respective rows of the light source array according to the timing voltage signals, the multiplexing of the driving sub-circuit can be achieved, the number of driving sub-circuits can be reduced, and the PCB size can be decreased.

According to another embodiment of the present disclosure, the selection sub-circuit 1 may comprise one or more multiplexers (MUXs). The control sub-circuit 2 is further configured to input timing voltage signals satisfying a preset delay to the MUXs that are connected to two adjacent rows of point light sources, such that the rows of point light sources are turned on sequentially.

In this embodiment, the control sub-circuit 2 may specifically comprise a driver IC for driving the backlight device. The driver IC is connected to a scan driving sub-circuit (such as a GOA driving sub-circuit); or a driving sub-circuit may be separately added between the scan driving sub-circuit and the driver IC for driving the backlight device.

Taking a driver IC of the backlight device as an example, upon the completion of the scan driving of a certain row of pixel units, the scan driving sub-circuit begins to count time, and when a preset time delay has been reached, an enable signal is generated, the driver IC is triggered to output a voltage signal to a MUX connected to a row of point light sources corresponding to the row of pixel units, so that the row of point light sources are turned on.

Alternatively, the scan driving sub-circuit may start to count time at the beginning of driving the scan of a row, and when the time meets a row scan time plus a preset time delay, an enable signal is generated, the driver IC is triggered to output a voltage signal to a MUX connected to a row of point light sources corresponding to the row of pixel units, so that the row of point light sources are turned on.

Alternatively, upon the completion of driving the scan of a certain row of pixel units, the scan driving sub-circuit triggers the driver IC to count time, and when a preset time delay has been reached, the driver IC outputs a voltage signal to a MUX connected to a row of point light sources corresponding to the row of pixel units, so that the row of point light sources are turned on.

Alternatively, the scan driving sub-circuit may trigger the driver IC to count time at the beginning of driving the scan of a row, and when the time meets a row scan time plus a preset time delay, the driver IC outputs a voltage signal to a MUX connected to a row of point light sources corresponding to the row of pixel units, so that the row of point light sources are turned on.

There are many specific implementation manners, which will not be enumerated here, as long as an enable signal may be obtained when a first delay is met after the row scan of a specific row of pixel units, and a voltage signal may be outputted to a MUX connected to a row of point light sources corresponding to the specified row of pixel units, so as to turn on the row of point light sources. This time-delayed row-by-row lighting can reduce the occurrence of smearing.

Optionally, the MUX may comprises transistors, and the transistors may be N type transistor or P type transistors. The transistor generally includes a first electrode, a second electrode, and a control electrode (i.e., a gate) for controlling ON/OFF between the first electrode and the second electrode. The first electrode is one of a source electrode and a drain electrode, the second electrode is the other of the source electrode and the drain electrode. The control electrode of the transistor may receive timing voltage signals from the control sub-circuit, the first electrode is connected to a first voltage input terminal, and the second electrode is connected to a corresponding row of point light sources. When a transistor is turned on, a voltage input at the first voltage input terminal may be provided to a corresponding row of point light sources, such that the row of point light sources are illuminated. It should be understood that besides the transistors, a MUX may comprises other devices such a control circuit, boost circuit, etc, and a person skilled in the art may design the MUX to comprise those devices according to their needs.

Optionally, the backlight source may include M rows and N columns of point light sources, the selection sub-circuit may include K MUX which is 1:Q, wherein M, N, K, Q are all positive integers and $K \times Q = M$. For example, in some embodiments of the present disclosure, the light source array of the backlight source may comprise 20 rows of point light sources, the selection sub-circuit may comprise five 1:4 MUX.

Further, the driving sub-circuit may include K driver IC. Each driver IC may comprise N output channels which is in one to one correspondence with the N columns of the light source array. Each driver IC can provide data signals to Q rows of point light source in the light source array.

Optionally, at least one of the MUXs may comprise a driver IC and W switching transistors, where W is an integer and $W \geq 2$. The driver IC have W output channels, such that the output channels of the driver IC are in one to one correspondence with the control electrodes of the switching transistors. For example, according to some embodiments of the present disclosure, the backlight source comprises 20 rows of point light sources, the selection sub-circuit comprises 16 switching transistors and one driver IC with 16 channels. The 16 output channels of the driver IC is connected to the 16 switching transistors in one to one correspondence. Further, a first electrode of each switching transistor may be connected to a power source terminal for illuminating the rows of the light sources in the light source array, and a second electrode may be connected to corresponding row of the light source array.

Figure 2:
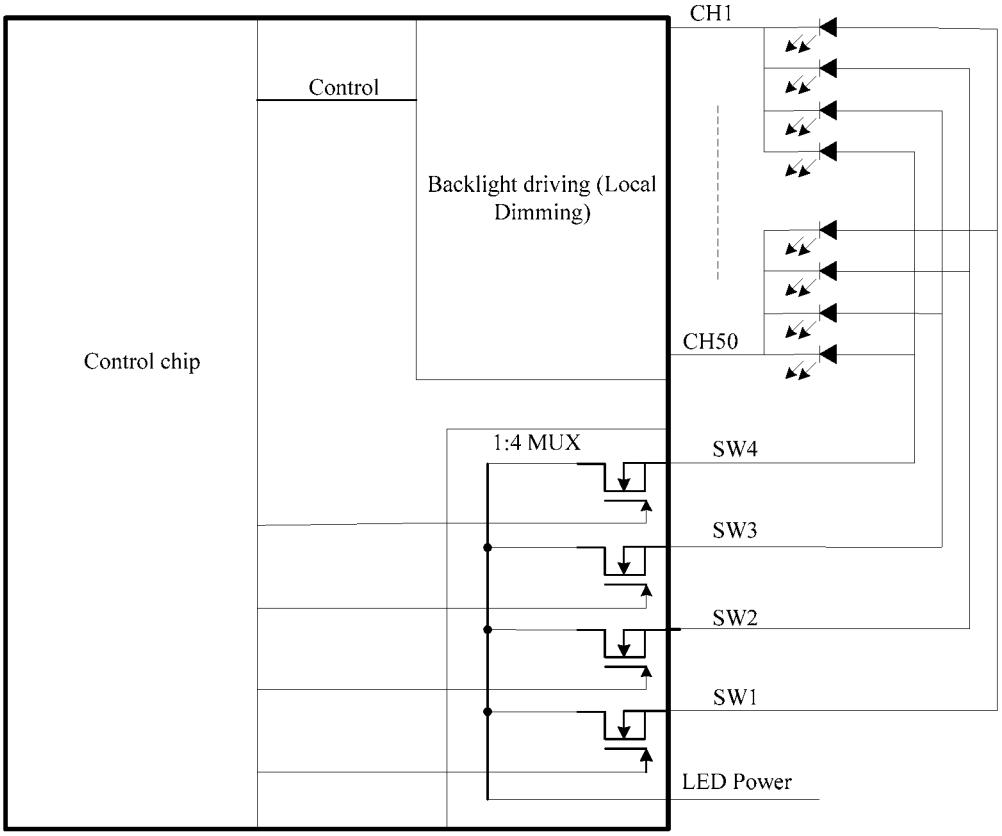
FIG. 2 is a schematic diagram of a connection structure of a 1:4 MUX driver IC and four rows of point light sources according to an embodiment of the present disclosure.

FIG. 2 is a schematic diagram of a connection structure between a backlight driving circuit with one 1:4 MUX and four rows of point light sources. The one 1:4 MUX comprises four switching transistors SW1-SW4 which are connected to the four point light sources respectively. The driving sub-circuit (backlight driver Local Dimming) is a driver IC with 50 channels, and each channel correspondes to one column of the point light sources. That is, one driver IC realizes control of 200 zones. The driver IC includes 50 channels: CH1-CH50, where SW1-SW4 are connected to the positive electrodes of point light sources of 50 channels, and the negative electrodes of the point light sources are connected to 50 channels.

The 1:4 MUX controls the turn-on or turn-off of the switching transistors SW1-SW4 according to different timing voltage signals outputted by the control chip. Through turning on or off SW1-SW4, corresponding rows of point light sources are turned on or off.

For example, when the voltage signal output from the driver IC is high, the corresponding switching transistor is turned on. When SW1 is turned on, the 50 channels of point light sources connected to SW1 are turned on. When SW2 is turned on, the 50 channels of point light sources connected to SW2 are turned on. When SW3 is turned on, the 50 channels of point light sources connected to SW3 are turned on. When SW4 is turned on, the 50 channels of point light sources connected to SW4 are turned on. That is, with one 1:4 MUX and a driver IC of 50 channels, 200 zones (4 rows by 50 columns) of point light sources can be turned on, and the amount of outlet wires of the driver IC can be reduced through channel multiplexing.

Figure 3:
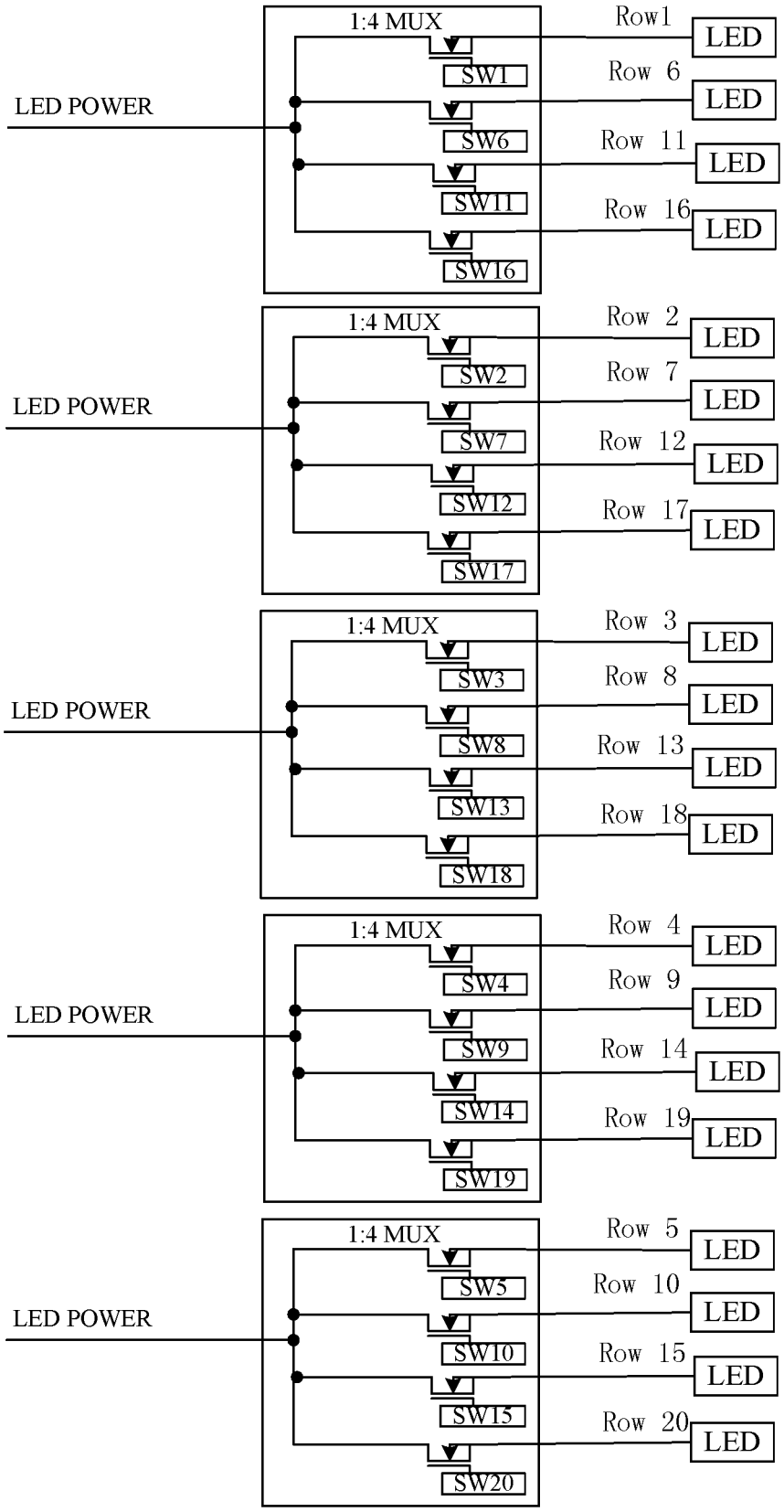
FIG. 3 is a schematic circuit diagram of a driving sub-circuit according to an embodiment of the present disclosure.

Referring to FIG. 3, which shows a schematic circuit diagram of the switch sub-circuit.

Specifically, in the example of FIG. 3, the backlight source includes 20 rows of point light sources and five 1:4 MUX. Each MUX comprises four switching transistors, and each of the switching transistors controls a row of point light sources. The rows of point light sources correspondingly connected to one MUX are separated by rows of point light sources corresponding to the other MUXs, i.e. the rows of the light source array that correspond to the same MUX are not adjacent to one another in the light source array. The serial numbers of the rows of point light sources correspondingly connected to the switching transistors of each MUX in the light source array of the backlight source are arranged in an arithmetic progression with a common difference of 5.

Figure 4:
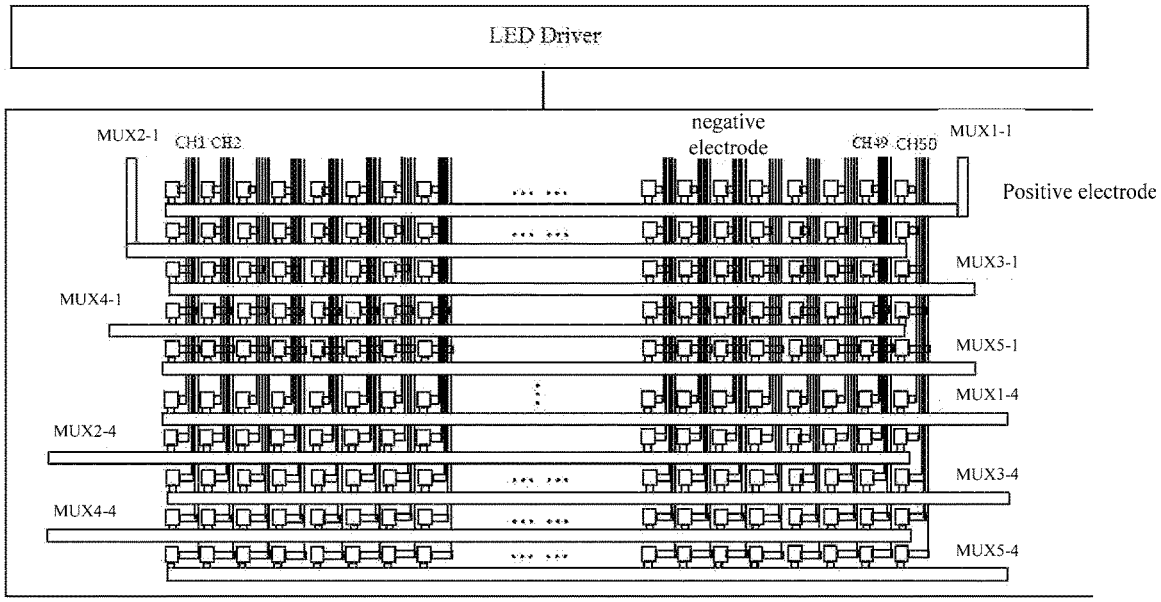
FIG. 4 is a schematic diagram of a connection structure of five 1:4 MUX driver ICs and respective rows of point light sources according to an embodiment of the present disclosure.

FIG. 4 is a schematic diagram of a connection structure of five 1:4 MUX driver IC and 20 rows of point light sources. Each driver IC comprises four switch sub-circuits. The positive electrodes of the point light sources are connected to the driver IC and the negative electrodes of the point light sources are connected to 50 channels of the driver IC.

According to the structural diagram of FIG. 4, as specifically shown in FIG. 3, MUX 1 comprises four switching transistors (SW1, SW6, SW11, and SW16), which are connected to rows 1, 6, 11, 16 respectively. The MUX 2 comprises four switching transistors (SW2, SW7, SW12, and SW17), which are connected to rows 2, 7, 12, 17 respectively. The MUX 3 comprises four switching transistors (SW3, SW8, SW13, and SW18), which are connected to rows 3, 8, 13, 18 respectively. The MUX 4 comprises four switching transistors (SW4, SW9, SW14, and SW19), which are connected to rows 4, 9, 14, 19 respectively. The MUX 5 comprises four switching transistors (SW5, SW10, SW15, and SW20), which are connected to rows 5, 10, 15, 20 respectively.

Figure 5:
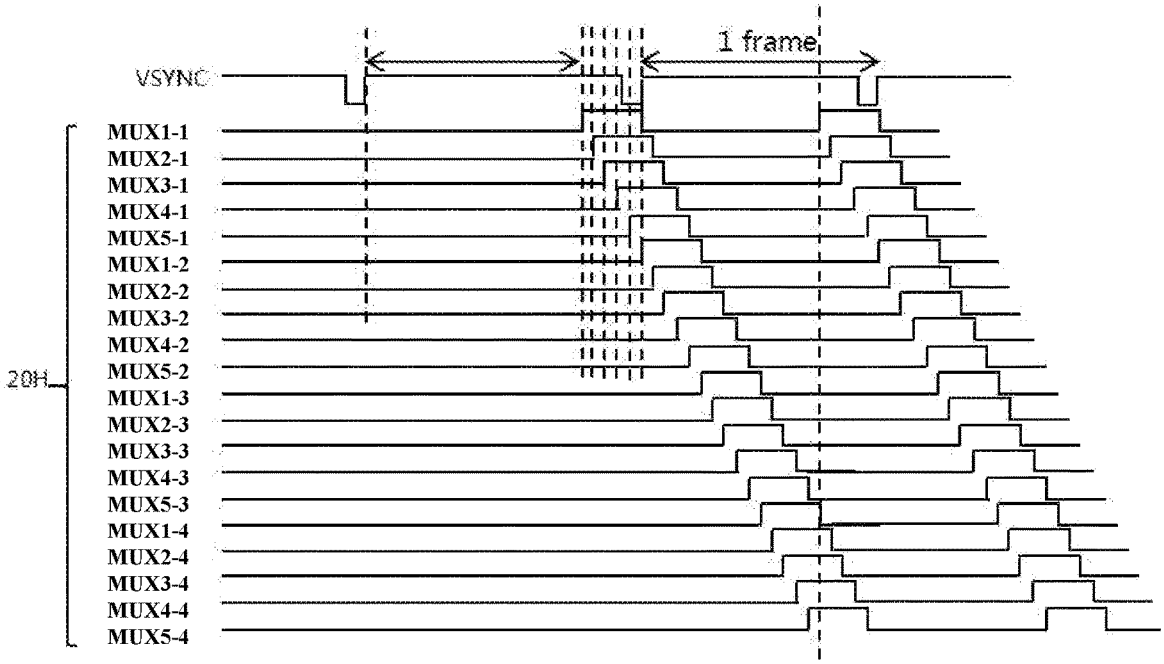
FIG. 5 is a schematic diagram of pulse signals according to an embodiment of the present disclosure.

In the above example, the turning-on/off of respective rows of point light sources are driven by pulse signals outputted from the control sub-circuit. The pulse signals can be controlled by changes in the scanning signal of the liquid crystal panel. Referring to FIG. 5, which shows timing voltage signals outputted from the control sub-circuit to five 1:4 MUX driver IC in case of 20 rows of point light sources. A specific form of the adopted pulse signals is shown in FIG. 5. The pulse signal at the first line in FIG. 5 is a frame synchronization signal VSYNC, which is a start signal of a frame of image displayed on the LCD panel. The second line to the sixth line are for rows of point light sources corresponding to driver MUX 1 to MUX 5, and "1 frame" represents one frame of image.

When five MUXs (MUX 1, MUX 2, MUX 3, MUX 4, MUX 5), according to the timing voltage signals shown in FIG. 5, turn on SW1, SW2, SW3, SW4, and SW5 in MUX 1-MUX 5 sequentially according to a preset delay, such that rows 1, 2, 3, 4, 5 connected to SW1, SW2, SW3, SW4, and SW5 are sequentially turned on (illuminated). After the duration of time of the preset high level signal of the driving sub-circuit is expired, SW1, SW2, SW3, SW4, and SW5 are turned off sequentially, and rows 1, 2, 3, 4, 5 of the point light sources are sequentially turned off. Then, rows 6, 7, 8, 9, 10 connected to SW6, SW7, SW8, SW9, and SW10 in the MUX 1-MUX 5 are sequentially turned on. That is, when SW1 is turned off, SW6 is turned on; when SW2 is turned off, SW7 is turned on; when SW3 is turned off, SW8 is turned on; when SW4 is turned off, SW9 is turned on; when SW5 is turned off, SW10 is turned on, and so on, until all 20 rows of point light sources are turned on. That is, by controlling the five MUXs to turn on simultaneously, five rows of point light sources can be turned on simultaneously. Each MUX may turn on point light sources of 200 zones. Through the multiplexing of five MUX, point light sources of 1000 zones can be turned on, so that the amount of wirings required by the backlight driving circuit can be decreased, and wire loss can be reduced.

From the timing voltage signals as shown in FIG. 5, it can be learned that for multiplexers MUX1-MUX 5, the four timing voltage signals received by MUX 1 (MUX 1-1 to MUX 1-4) do not overlap. For the same reasons, four timing voltage signals received by each of MUX 2 to MUX 5 do not overlap. That is to say, time delay of timing voltage signal received by the same MUX is equal to or larger than a width of the timing voltage signal.

Further, from the timing voltage signals of FIG. 5, it can also learned that timing voltage signals for different MUXs can be overlap. For example, the timing voltage signal for MUX 1-1 may be overlap, in some degree, with the timing voltage signals for MUX 2-1, MUX 3-1, MUX 4-1 and MUX 5-1. That is to say, a time delay among timing voltage signals received by multiple MUXs can be smaller than the width of the timing voltage signal.

It should be noted that this embodiment mainly introduces 1:4 MUX that are controlled to turn on different rows of point light sources in the manner of arithmetic progression. In practical applications, 1:6 MUX or 1:8 MUX can also be adopted. Appropriate number of MUXs can be selected according to the number of rows of point light sources to be controlled, which is not specifically limited.

Figure 6:
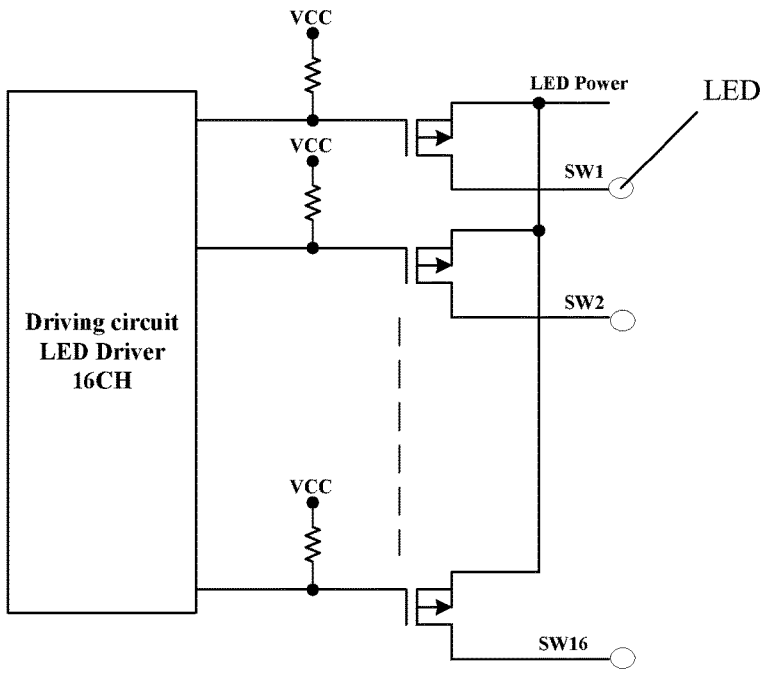
FIG. 6 is a schematic structural diagram of a connection relationship between a 16CH driver IC and switch sub-circuits according to an embodiment of the present disclosure.

FIG. 6 shows a 16CH (16 channels, CH1 to CH16) driver IC. The 16 channels of the 16CH driver IC are correspondingly connected to 16 switching transistors SW1-SW16, and SW1-SW16 are connected to rows of point light sources (LEDs).

The driver IC controls the ON or OFF of the switching transistors SW1-SW16 according to different timing voltage signals outputted from the control sub-circuit, and corresponding rows of point light sources are turned on or off by turning on or off SW1-SW16.

For example, when CH1 is not selected, CH1 is in a high resistance state, and the control electrode of switching transistor SW1 which is connected to CH1 is at a high level VCC, so that the switching transistor SW1 is turned off. When CH1 is selected, this channel CH1 is in a low resistance state, such that the gate voltage of the switching transistor SW1 is pull down to a low level, and th transistor S1 is turned on. In case that the switching transistor SW1 is turned on, a voltage of LED power source is provided to corresponding row of point light sources (LEDs) through the switching transistor SW1, and the row of point light sources are turned on. Further, when CH1 is selected, other channels CH2-CH16 are not selected, and corresponding switching transistors SW2-SW16 are turned off, and rows of point light source corresponding to the switching transistors SW2-SW16 do not turned on. Thus, when a row of point light sources in the light source array needs to be turned on, the driver IC may be controlled to select a corresponding channel and keep other channels unselected. so as to achieve the turning on/off of respective rows of point light sources. Thereby, control of respective rows of point light sources is achieved through channel multiplexing.

Figure 7:
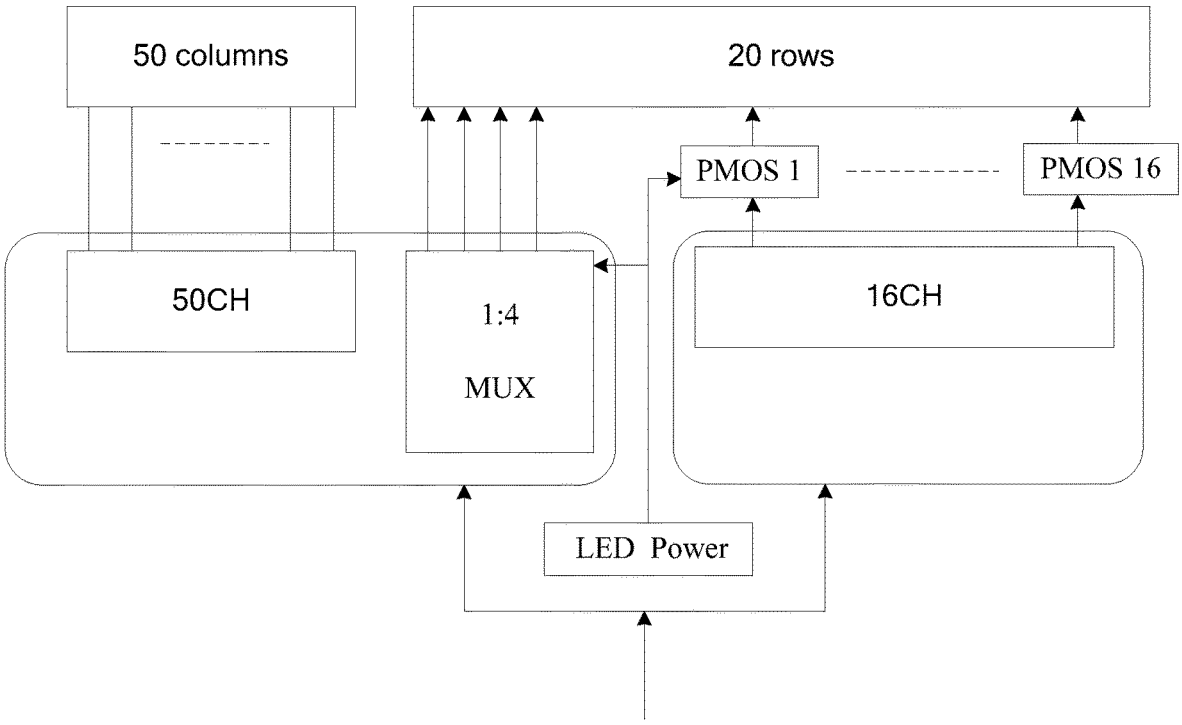
FIG. 7 is a schematic diagram of a connection relationship where a 1:4 MUX driver IC and a 16CH driver IC are connected to 20 rows of point light sources according to an embodiment of the present disclosure.

Referring to FIG. 7, which shows a schematic diagram of a connection relationship where a 1:4 MUX and a 16CH driver IC are connected to 20 rows of point light sources.

The selection sub-circuit of the present embodiment includes two MUXs. One is a 1:4 MUX, and the other comprises a 16CH driver IC and 16 PMOS.

The 1:4 MUX is similar to the 1:4 MUX described with reference to the above embodiments, and is not repeated.

16 output channels of the 16CH driver IC are connected to the control electrodes of 16 PMOS in a one to one correspondence. The first electrodes of the PMOS are connected to a LED power source, the second electrodes are connected to corresponding rows in the light source array. The negative electrodes of 50 columns of point light sources are connected in one-to-one correspondence with 50 output channels of the 50CH driving sub-circuit. Then, the control sub-circuit is triggered according to the VSYNC signal to output different timing voltage signals to the MUXs, thereby controlling the switching transistors to be turned on or off. The corresponding rows of point light sources are turned on, thereby achieving control of 1000 zones using two driver ICs.

The present disclosure also provides a backlight device including the backlight driving circuit according to the various embodiments of the present disclosure described above.

The backlight device has all the advantages of the backlight driving circuit in the various embodiments above, which will not be repeated.

The present disclosure also provides a display device including the backlight device according to the various embodiments described above.

It should be noted that the display device in this embodiment may be a mobile phone, a tablet computer, a TV, a notebook computer, a digital frame, a navigator or any other product or component having display function.

The display device has all the advantages of the backlight device in the various embodiments above, which will not be repeated.

Figure 8:
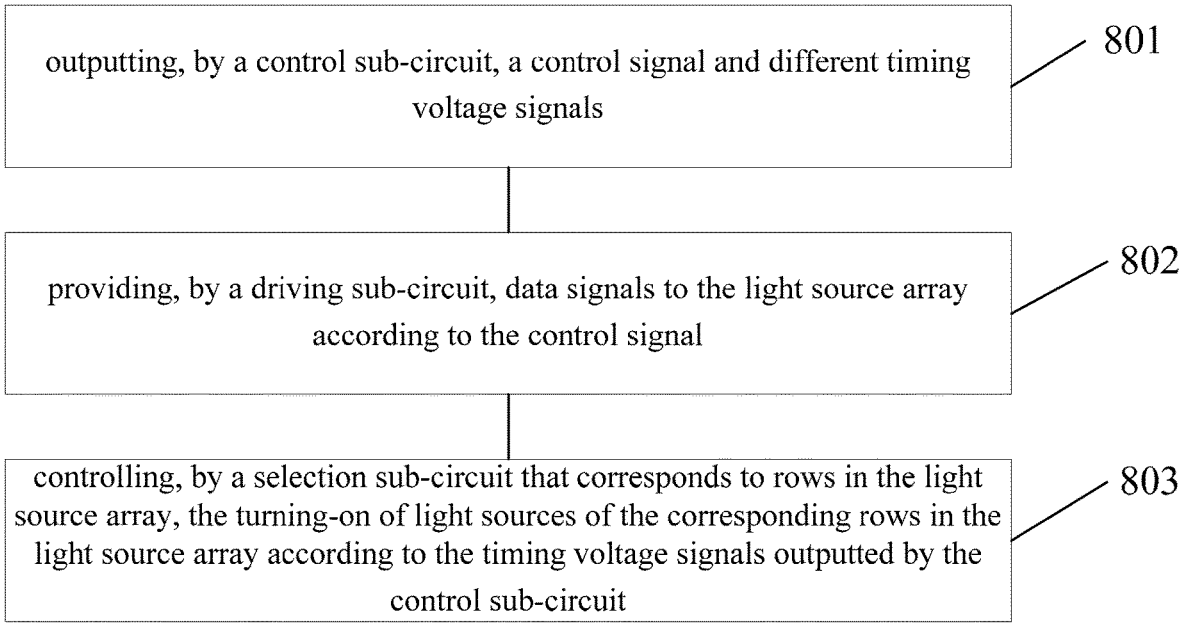
FIG. 8 is a flowchart of a backlight driving method according to an embodiment of the present disclosure.

Referring to FIG. 8, which shows a method for driving the backlight device according to an embodiment of the present disclosure. The backlight device including a plurality of point light sources arranged in an array, the method includes:

step 801: outputting, by a control sub-circuit, a control signal and different timing voltage signals;

step 802: providing, by a driving sub-circuit, data signals to the light source array according to the control signal; and step 803: controlling, by a selection sub-circuit that corresponds to rows in the light source array, the turning-on of light sources of the corresponding rows in the light source array according to the timing voltage signals outputted by the control sub-circuit.

Optionally, the selection sub-circuit includes one or more multiplexers (MUXs).

Optionally, the control sub-circuit outputting different timing voltage signals to the selection sub-circuit comprises:

inputting, by the control sub-circuit, timing voltage signals satisfying a preset delay to the MUXs that correspond to two adjacent rows in the light source array, such that the rows are turned on sequentially.

In some embodiments according to the present disclosure, the backlight source includes a plurality of point light sources arranged in an array. The backlight driving circuit includes: a control sub-circuits, a selection sub-circuits and a driving sub-circuit, wherein the control sub-circuit is configured to output different timing voltage signals a control signal; the driving sub-circuit is configured to provide data signals to the light source array according to the control signal; and the selection sub-circuit corresponds to rows in the light source array, and is configured to control the turning-on of light sources of the corresponding rows in the light source array according to the timing voltage signals outputted by the control sub-circuit. With the selection sub-circuits controlling the turning-on of corresponding rows of point light sources according to the timing voltage signal, the multiplexing of the driving sub-circuit may be achieved, the number of driving sub-circuits is reduced, and the PCB size may be decreased.

It should be noted that, for a simple description, the foregoing embodiments of the method have been described as a series of combinations of actions, but those skilled in the art shall appreciate that the present disclosure will not be limited to the described sequence of actions because some of the steps can be performed in a different sequence or concurrently according to the present disclosure. Secondly, as appreciated by those skilled in the art, all the embodiments described in the description are preferred embodiments, and activities involved therein are not necessarily required to implement the present disclosure.

For the foregoing method embodiment, it has been described in a relatively simple manner because it is basically similar to the apparatus embodiment. For related parts, reference may be made to the part of the apparatus embodiment.

Each embodiment in this description is described in a progressive manner and focuses on differences from other embodiments. For the same or similar parts of the various embodiment, reference can be made to each other.

As readily conceived by those skilled in the art, any combined application of the above embodiments is feasible, so any combination of the above embodiments is an embodiment of the disclosure, which however will not be described in detail herein due to space limitations.

Note that, in this description, the use of relational terms, if any, such as first and second and the like are used solely to distinguish one from another entity or action without necessarily requiring or implying any actual such relationship or order between such entities or actions. Further, terms "include", "comprise" or their any other variations are intended to encompass non-exclusive composition, so that a process, method, product or device comprising a series of factors may comprise not only these factors, but also other factors that are not listed explicitly, or factors intrinsic to this process, method, product or device. Without limitation, a factor defined by wording "comprise one . . . " does not exclude the existence of other same factors in a process, method, product or device comprising such factor.

Moreover, the wording "and/or" used above is intended to including both a "and" relationship and a "or" relationship, wherein: if scheme A and scheme B have a "and" relationship therebetween, it indicates that an embodiment may include both scheme A and scheme B simultaneously; if scheme A and scheme B have a "or" relationship therebetween, it indicates that an embodiment may only include scheme A, or only include scheme B.

Although preferred embodiments of the present disclosure have been already described, once those skilled in the art understand basic creative concept, they can make additional modification and alteration for these embodiments. Therefore, the attached claims are intended to comprise preferred embodiments and all modifications and variations covered by the scope of the present disclosure.

A manufacturing method of an array substrate, an array substrate and a display apparatus provided in the present invention have been described in detail above. Specific examples are applied in this text to elaborate the principles and embodiments of the present utility model, and the aforementioned descriptions of the embodiments are only used to help understanding the method of the present invention as well as its core thoughts. For those of ordinary skill in the art, according to the concept of the present disclosure, variations can be made to the embodiments and application scope of the present disclosure. To sum up, the contents of the present disclosure cannot be understood as limitations to the present disclosure.

The invention claimed is:

1. A backlight driving circuit for driving a light source array, comprising: a control sub-circuit for outputting a control signal and different timing voltage signals; a driving sub-circuit for providing data signals to the light source array according to the control signal; and a selection sub-circuit that corresponds to rows in the light source array, wherein the selection sub-circuit is configured to control the turning-on of light sources of the corresponding rows in the light source array according to the timing voltage signals outputted by the control sub-circuit, wherein the light source array includes M rows and N columns, and the selection sub-circuit includes K multiplexers (MUXs) that are 1:Q, wherein M, N, K and Q are all positive integers, and $K \times Q = M$; and the driving sub-circuit includes K driver ICs, each driver IC includes N output channels, the N output channels and the N columns of the light source array are in one to one correspondence, and each driver IC provides the data signals to corresponding Q rows of light sources.

2. The backlight driving circuit according to claim 1, wherein the control sub-circuit is further configured to input timing voltage signals satisfying a preset delay to the MUXs that correspond to two adjacent rows in the light source array, such that the rows are turned on sequentially.

3. The backlight driving circuit according to claim 2, wherein the selection sub-circuit includes a plurality of MUXs, and rows of the light source array that corresponds to the same MUX are not adjacent to one another.

4. The backlight driving circuit according to claim 3, wherein rows of the light source array are numbered sequentially from 1 to M, the serial numbers of the rows in the light source array corresponding to the same MUX are in an arithmetic progression with a common difference of K.

5. The backlight driving circuit according to claim 4, wherein M=20, K=5, Q=4.

6. A backlight device, comprising the backlight driving circuit according to claim 1.

7. A display device, comprising the backlight device according to claim 6.

8. A backlight driving circuit for driving a light source array, comprising:

a control sub-circuit for outputting a control signal and different timing voltage signals;

a driving sub-circuit for providing data signals to the light source array according to the control signal; and a selection sub-circuit that corresponds to rows in the light source array, wherein the selection sub-circuit is configured to control the turning-on of light sources of the corresponding rows in the light source array according to the timing voltage signals outputted by the control sub-circuit, wherein the selection sub-circuit includes one or more multiplexers (MUXs), at least one of the one or more MUXs includes W switching transistors and a driver IC with W output channels, the output channels of the driver IC are connected to control electrodes of the switching transistors in one to one correspondence, first electrodes of the switching transistors are connected to a power source terminal, second electrodes of the switching transistors are connected to corresponding row of the light source array, and the control electrodes are also connected to a high level terminal, W is a positive integer and W≥2.

9. A backlight device, comprising the backlight driving circuit according to claim 8.

10. A display device, comprising the backlight device according to claim 9.

11. A method for driving a light source array, comprising:

outputting, by a control sub-circuit, a control signal and different timing voltage signals;

providing, by a driving sub-circuit, data signals to the light source array according to the control signal; and controlling, by a selection sub-circuit that corresponds to rows in the light source array, the turning-on of light sources of the corresponding rows in the light source array according to the timing voltage signals outputted by the control sub-circuit, wherein the selection sub-circuit includes one or more multiplexers (MUXs), and outputting, by the control sub-circuit, different timing voltage signals comprises:

inputting, by the control sub-circuit, timing voltage signals satisfying a preset delay to the MUXs that correspond to two adjacent rows in the light source array, such that the rows are turned on sequentially.

12. The method according to claim 11, wherein a delay between the timing voltage signals received by the same MUX is equal to or larger than a width of the timing voltage signals.

13. The method according to claim 11, wherein the selection sub-circuit includes a plurality of MUXs, and rows of the light source array that corresponds to the same MUX are not adjacent to one another.

14. The method according to claim 13, wherein delays among the timing voltage signals received by the plurality of MUXs are smaller than a width of the timing voltage signals.

* * * * *